United States Patent [19]

LaPorte et al.

[11] 3,971,357

[45] July 27, 1976

[54] METHOD AND APPARATUS FOR THROWING FRANGIBLE TARGETS

[76] Inventors: Jean-Michel LaPorte; Jean-Claude LaPorte, both of Pont de la Brague, 06600 Antibes, France

[22] Filed: Dec. 27, 1974

[21] Appl. No.: 536,989

[30] Foreign Application Priority Data

Jan. 2, 1974 France ..... 74.00018

[52] U.S. Cl. ..... 124/8; 124/32; 124/43; 124/36

[51] Int. Cl.[2] ..... F41B 3/04

[58] Field of Search ..... 124/8, 7, 6, 32, 43, 124/36

[56] References Cited

UNITED STATES PATENTS

| | | | |
|---|---|---|---|
| 1,475,713 | 11/1923 | Napier | 124/8 |
| 2,078,166 | 4/1937 | Schwerin | 124/8 |
| 2,245,258 | 6/1941 | Darrell | 124/8 |
| 2,711,163 | 6/1955 | Richardson | 124/8 |
| 3,070,082 | 12/1962 | Foster | 124/8 |
| 3,071,222 | 1/1963 | Koenig et al. | 188/82.84 X |
| 3,093,127 | 6/1963 | Starr | 124/8 |

*Primary Examiner*—Richard C. Pinkham
*Assistant Examiner*—William R. Browne

[57] ABSTRACT

Apparatus for throwing objects, and particularly "clay pigeons" for target shooting, wherein a spring driven throwing arm is locked in a position wherein the spring is in tension but the arm must be further mechanically driven against the spring tension to an equilibrium point where the throwing stroke will take place under the influence of the spring. The position of the throwing arm is controlled by an electric motor, a pair of parallel circuits for controlling the energization of the motor and a drive train between the motor and the shaft which supports the throwing arm; the drive train including a ratchet type arrangement which constrains the arm to movement in only one direction and "captures" the arm on "rebound" of the spring at the end of a throw.

7 Claims, 11 Drawing Figures

METHOD AND APPARATUS FOR THROWING FRANGIBLE TARGETS

BACKGROUND OF THE INVENTION

1. Field of the Invention

The present invention relates to the dispensing of objects individually and particularly to the throwing of "clay pigeon" targets. More specifically, this invention is directed to apparatus for receiving and throwing plate type targets characterized by a catapult arm which is operated in such a manner as to minimize target breakage and which is partially automatically recocked subsequent to the throwing of each target. Accordingly, the general objects of the present invention are to provide novel and improved methods and apparatus of such character.

2. Description of the Prior Art

Apparatus for throwing "clay pigeon" plate type targets wherein the throwing or catapult arm is mechanically driven are well known in the art. In such apparatus the drive means, which actually imparts momentum to the throwing arm, is typically a powerful traction spring. The prior art apparatus thus generally comprises a throwing arm, designed to accomodate a frangible target plate, mounted on one end of a rotatable shaft. The other end of the rotatable shaft is mechanically coupled to a crank mechanism which, in turn, is connected to the traction spring. In operation the throwing arm must be moved to an angular position in which the spring is stretched, the arm must thereafter be released for the throwing stroke and then the arm is returned to the fully cocked position.

Various techniques and apparatus have previously been proposed to accomplish, against the force of the traction spring, the cocking of throwing arm of target plate throwing apparatus. Thus, by way of example, use has been made of compressed air jacks which, via a suitable transmission, pivot the rotatable shaft toward the arm cocked position after each throw. Systems employing compressed air jacks are expensive, complex and have a slow operational cycle. Accordingly, cocking devices for plate throwing apparatus which employ compressed air jacks or equivalent hydraulic means have not met wide acceptance and most prior art automatic plate throwing apparatus have employed motors which drive the rotatable shaft through reduction gearing.

The prior art motor driven devices for setting the throwing arms of target dispensing apparatus have also been characterized by certain difficulties and deficiencies. Thus, again by way of example only, the rotatable shaft to which the throwing arm is attached must be completely free for movement during the throwing stroke and thus the shaft can not be permanently driven. The apparatus must, accordingly, be provided with an angle pinion loosely mounted on the rotatable shaft; the angle pinion being connected by cooperating pinions to the reduction gearing on the drive motor output shaft. The angle pinion must, of course, be driven only through an arc, for the cocking of the throwing arm, and must be disconnected from the drive apparatus during the throwing stroke. Apparatus of the type described immediately above is complex, and thus comparatively expensive, and requires use of a powerful motor.

The target projecting arm, under the action of the traction spring, pivots at high speed during the throwing stroke and, because of the mass of and thus the inertia of the arm, moves beyond that angular position in which the spring is least stretched. Restated, at the end of the throwing stroke the traction spring tends to return the arm toward the cocked position producing oscillatory motion of the arm which results in considerable vibration. Such vibration or "bounce" can cause serious damage both to the throwing apparatus and to fragile targets positioned thereon or stored adjacent thereto. In an effort to overcome vibration of the throwing arm at the end of the throwing stroke it has been proposed to equip the rotatable shaft with a device which exerts a clamping effect in one direction only thus constraining the shaft to rotation in only one direction. These prior art vibration impeding devices, however, are characterized by the drive motor being constantly in rotation. This characteristic, in turn, requires that the throwing arm be locked in a cocked position and further requires that means be provided for disconnecting the motor output shaft from the remainder of the throwing arm drive apparatus. Thus, to enable a throwing operation, prior art devices with an arm vibration prevention feature have also had to include a throwing arm release mechanism.

SUMMARY OF THE INVENTION

The present invention overcomes the above discussed and other deficiencies and disadvantages of the prior art by providing a novel and improved device particularly well suited for use in apparatus for the throwing of clay pigeon type targerts. In accordance with a preferred embodiment, the present invention comprises a housing which supports a pivotal shaft. In the environment of a target or plate throwing mechanism, the first end of a throwing arm is affixed to the first end of the pivotal shaft and a crank mechanism is connected to the other end of the shaft. A first end of a traction spring is attached to the crank mechanism by means of a crank pin and the second end of the spring is grounded to the housing. The apparatus also includes an electric drive motor. In accordance with a first embodiment, the drive motor is coupled to the crank pin of the crank mechanism on the pivot shaft via reduction gearing. The motor controls the location of the shaft to place the shaft at an angular position at which the throwing arm is in readiness for operation, but not fully cocked and the traction spring is under tension. Restated, in accordance with the present invention the throwing arm is retained in a partially cocked position; i.e., an angular position where the traction spring is under tension but where the arm must be further driven so as to reach the equilibrium point where the arm will be released to the action of the spring. The apparatus also consists of means, including a novel control circuit, for releasing the pivotal shaft so as to enable the shaft and thus the throwing arm to pivot under the influence of the traction spring in order to effect the throwing operation. The invention is characterized by the use of a unidirectional clamping device, interposed between the output shaft of the reduction gearing and the pivotal shaft of the apparatus. The invention further comprises means for de-energizing the drive motor when the throwing arm occupies a desired partially cocked position; the throwing arm being held in the partially cocked positon by the unidirectional clamping device. The aforementioned control circuitry commands the starting of the motor to accomplish release of the throwing arm and also controls recocking of the arm for a subsequent target throwing operation.

Continuing with a discussion of the utilization of the present invention in a target throwing mechanism, the apparatus of the present invention results in very rapid recocking of the throwing arm. As a result of the use of a unidirectional clamping device, the output shaft of the drive motor reduction gearing is connected to the main pivotal shaft during the cocking operation while these two components are disconnected during the throwing stroke. The traction spring causes rotation of the crank pin and the throwing arm during the throwing stroke. The throwing arm, moving solely under the influence of the traction spring, pivots through an angle in excess of that required for the projection of the target; i.e., the crank passes beyond the position in which the traction spring is least stretched. The unidirectional clamping device permits the pivotal shaft to rotate only in the direction corresponding to the throwing operation and, since the shaft can not rotate in the opposite direction under the influence of the spring at the end of the "overshoot" portion of the throwing stroke, the shaft will be recoupled to the output shaft of the reduction gearing at a position very close to that in which the throwing arm is precocked. Accordingly, very slight rotation of the drive motor subassembly output shaft will suffice to drive the throwing arm to the cocked position. As used herein the terms "cocked position" and "partially cocked position" are used synonymously to refer to a condition where the throwing arm has not reached the equilibrium position and the traction spring has not been fully stretched. Thus, in accordance with the present invention, part of the energy supplied by the traction spring is utilized for the cocking of the throwing arm.

Continuing with a discussion of the present invention as associated with a target throwing mechanism, the angular position occupied by the pivotal shaft when the throwing arm is in the cocked position is located, in the direction of rotation of the shaft, prior to the position in which the throwing arm is released to the influence of the traction spring. Accordingly, stop means serving to hold the arm in a cocked position, as have been common in the prior art, may be dispensed with as well as means for retracting such stop means when not in use.

In terms of actual hardware, unidirectional clamping devices in accordance with a preferred embodiment of the invention consist of a ratchet wheel, keyed onto the output shaft of subassembly comprising the drive motor and its associated reduction gearing, and a cooperating ratchet wheel. In a first embodiment of the invention the ratchet wheel is affixed to the crank pin of crank assembly on the pivotal shaft. In accordance with a second embodiment of the invention the motor subassembly output shaft comprises a worm gear which interacts with a pinion mounted on the pivotal shaft of the apparatus. In the second embodiment the unidirectional clamping means is interposed between the worm gear and the main pivotal shaft.

Also in accordance with a preferred embodiment of the invention, the drive motor consists of an electric motor. The drive motor is connected to a suitable electric power supply by means of a control circuit. The control circuit includes two parallel paths for energizing the drive motor. The first of these parallel circuits includes a normally closed switch which is opened by a finger extending from the pivotal shaft; the first current supply circuit for the motor being opened when the throwing arm has reached the position of readiness for operation; i.e., the partially cocked position. The second parallel current supply circuit includes a normally open push button type switch which is momentarily closed by the operator when the apparatus is partially cocked to institute a target throwing operation.

The above described electrical control circuit, in cooperation with the previously described mechanical features and particularly the unidirectional clamping device, produces a mechanism which is very economical from the point of view of consumption of energy. The drive motor operates only during a short space of time, rather than being in constant rotation, and supplies very little force since a sizeable portion of the energy stored in the traction spring during the throwing stroke is utilized to recock the throwing arm. When the parallel circuit including the manually operated switch is completed the motor drives the pivotal shaft of the apparatus only from the partially cocked position in which the pivotal shaft is "captured" by the unidirectional clamping means to the position in which the arm is released to the spring. The angular displacement of the shaft between the cocked position of the throwing arm and the position in which the throwing arm is free to rotate solely under the influence of the traction spring is small and, as previously noted, during the throwing stroke the pivotal shaft and the motor are decoupled so that the motor may rotate without any load and reach its normal rotational speed at the moment when the two shafts are again interconnected.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENTS

Figure 1:
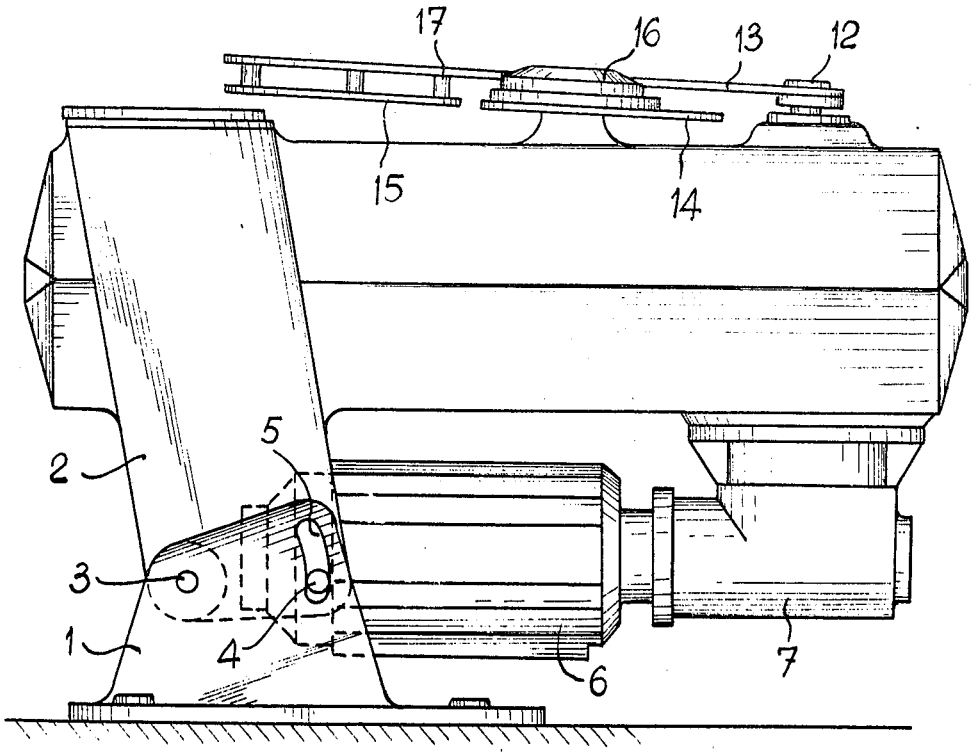
FIG. 1 is a side elevation view of a target throwing device in accordance with the present invention.

With reference now to the drawing, and particularly jointly to FIGS. 1–4, a target throwing device comprising a base 1 intended for mounting, for example by bolts, to a frame or other suitable support is depicted. The body or housing of the throwing device, indicated at 2, is mounted from base 1 so as to be rotatable, in a vertical plane, about a horizontal shaft 3. The housing 2 may be locked in any desired position, thus defining the trajectory of the plates which are to be thrown, through the use of screws for which pass through arcuate slots 5 provided in base 1.

An electric motor 6 is mounted within housing 2. Appropriate reduction gearing, indicated at 7, is keyed to the shaft of motor 6. The output shaft 8 of reduction gearing 7 comprises the output or drive shaft of the motor subassembly. In the manner to be described below, the throwing arm of the target throwing device is driven to the cocked position by drive shaft 8. As may be seen from joint consideration of FIGS. 2 and 3, a ratchet wheel 9 is keyed to drive shaft 8.

Housing 2 also provides support for a bearing assembly 11. A main pivotal shaft 12 is supported in bearing assembly 11 as shown. The upper end of shaft 12 is keyed to the first end of a throwing arm 13; the throwing arm including a horizontal plate 15 and a guide bar 17 as may best be seen from FIG. 4. The targets to be thrown, for example the clay pigeon or plate 16 of FIG. 4, will be serially delivered onto a fixed support 14 so as to be in position to be picked up by the moving throwing arm. The plate 15 is curved in order to fit the shape of the fixed support 14 and the bar 17 has a gradient which, when the throwing arm rotates in the direction indicated by the arrow on FIG. 4, tends to move the plate 16 toward the free end of arm 13.

A crank assembly 19 having a generally downwardly extending crank pin 20 is keyed to the lower end of shaft 12. A connecting ring 22 is mounted on the crank pin 20. Ring 22 is provided with a socket which receives the first end of a bar 23. For the purposes to be described below, a pawl 21 is mounted from the lower end of crank pin 20.

The second end of bar 23 is coupled to the first end of a traction spring 24. The second end of traction spring 24 is affixed to a further bar 25 which extends through and threadably engages a tapped hole 27 provided in the housing 2. Adjusting means, in the form of a regulating wheel 30, is provided whereby the tension of spring 24 may be adjusted by varying the point of engagement of a threaded portion of bar 25 with the tapped hole 27 in housing 2.

Figure 2:
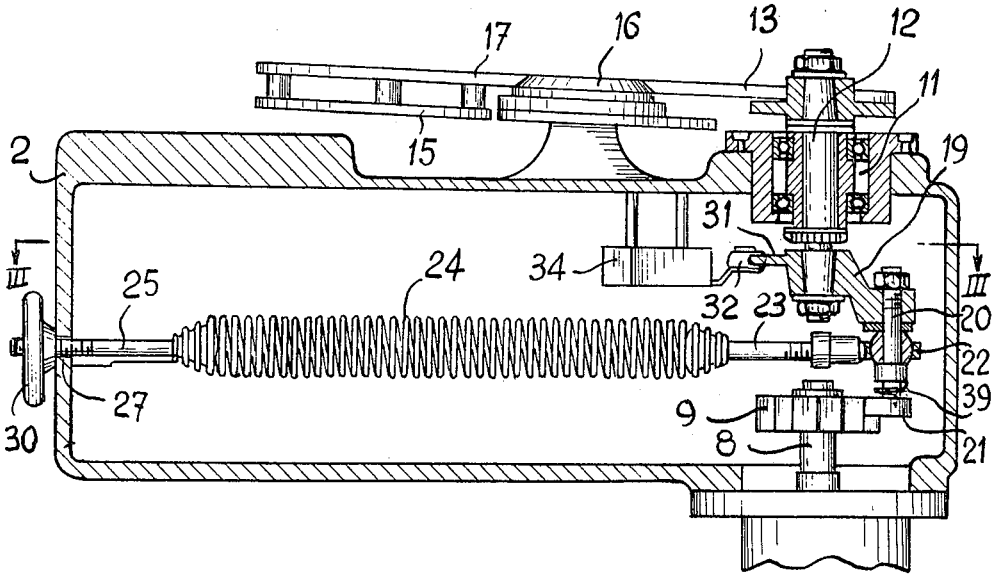
FIG. 2 is a partial cross-sectional side elevation view of the apparatus of FIG. 1, FIG. 2 depicting a first embodiment of the present invention.

As will be obvious from FIG. 2, the motor subassembly output drive shaft 8 and the pivotal shaft 12 are coaxial. Interaction between pawl 21 on crank pin 20 and ratchet wheel 9 on drive shaft 8 is insured by spring 39 which biases the pawl toward the position shown in FIGS. 6 and 8. The embodiment of FIGS. 1–4 is completed by a finger 31, extending from crank 19, which cooperates with the actuating member 32 of an electrical switch 34. Switch 34 forms part of the electrical control circuit shown schematically in FIG. 5.

The apparatus of FIGS. 1–4 may be supplemented by an automatic plate distributing device which may, for example, be of the type described in French Pat. Nos. 1,472,432 and 1,435,475 of Pierre Laporte.

Before discussing the operation of the apparatus of FIGS. 1–5, the target throwing system of FIGS. 9–11 will be described. The apparatus of FIGS. 9–11 comprises a base 60 pivotally supporting a housing 61. A drive motor subassembly 62 is mounted from housing 61 as shown in FIG. 11. Motor subassembly 62 includes an electric motor and reduction gearing which drives an output shaft consisting of a worm gear 63.

As in the case of the apparatus of FIGS. 1–4, housing 61 provides support for a bearing assembly 64. A pivotal shaft 65 is supported in bearing assembly 64 as shown. The upper end of shaft 64 is keyed to the first end of a throwing arm 66; the throwing arm including a plate 67 and a guide bar 69. The plates to be thrown, for example plate 67, will be serially delivered onto a fixed support 68 so as to be in position to be picked up by the moving throwing arm. The throwing arm of the apparatus of FIGS. 9–11 is similar to that described above in the discussion of FIGS. 1–4 and thus will not be further described.

Figure 10:
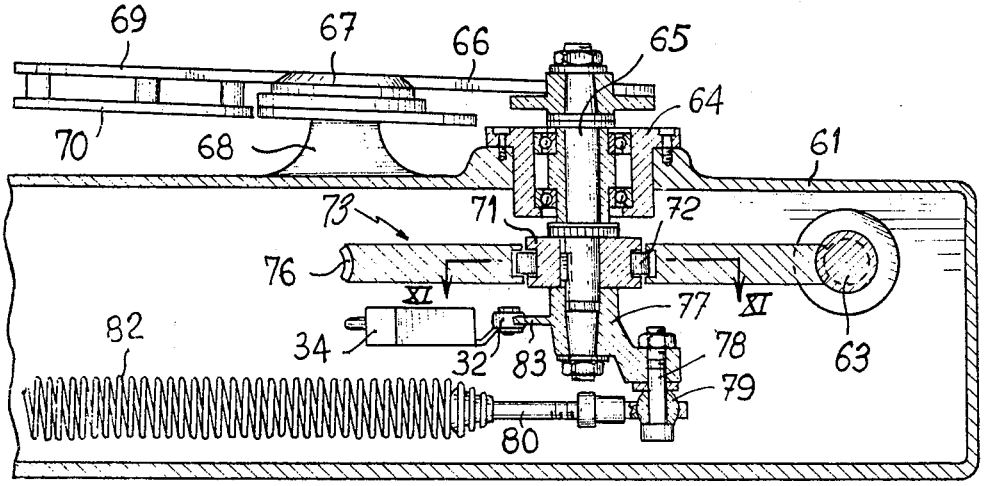
FIG. 10 is a partial cross-sectional side elevation view of the apparatus of FIG. 9, FIG. 10 depicting a second embodiment of the present invention.
Figure 11:
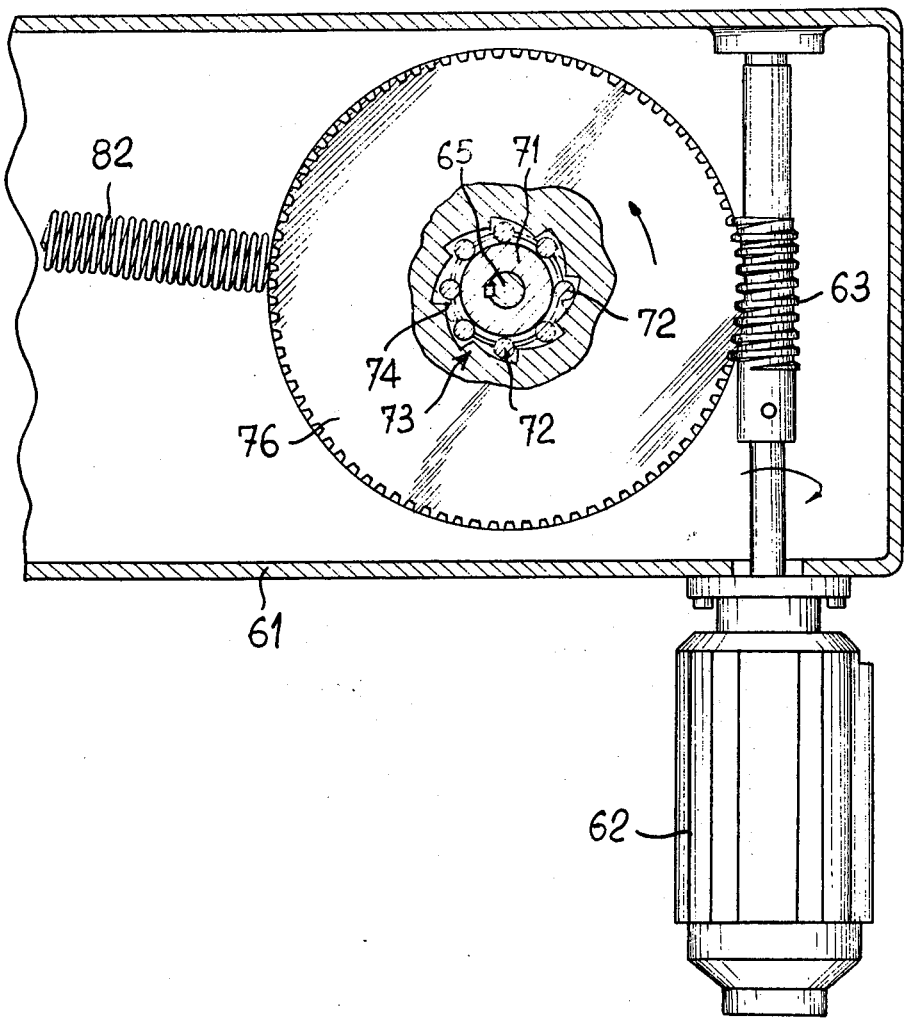
FIG. 11 is a top plan view taken along a line XI—XI of FIG. 10.

A ring 71 is keyed to the pivotal shaft 65 as shown in FIG. 10. Ring 71 is shaped to form part of a cage for the rollers 72 of a unidirectional clamping device indicated generally at 73. The other portion of the cage for rollers 72 and the ramps 74 of the clamping device are formed at the inner diameter of a cog wheel 76. Wheel 76 is coaxial with pivotal shaft 65. The worm gear 63 on the drive shaft from the motor subassembly meshes with and thus drives the cog wheel 76.

A crank assembly 77 is keyed to the lower end of pivotal shaft 65. Crank assembly 77 has a generally downwardly extending crank pin 78 which supports a connecting ring 79. Ring 79 is provided with a socket which receives the first end of a bar 80. The second end of bar 80 is coupled to a first end of traction spring 82. The second end of the traction spring is secured to the housing 61 in the same manner as shown in the case of spring 24 of FIG. 2.

Figure 5:
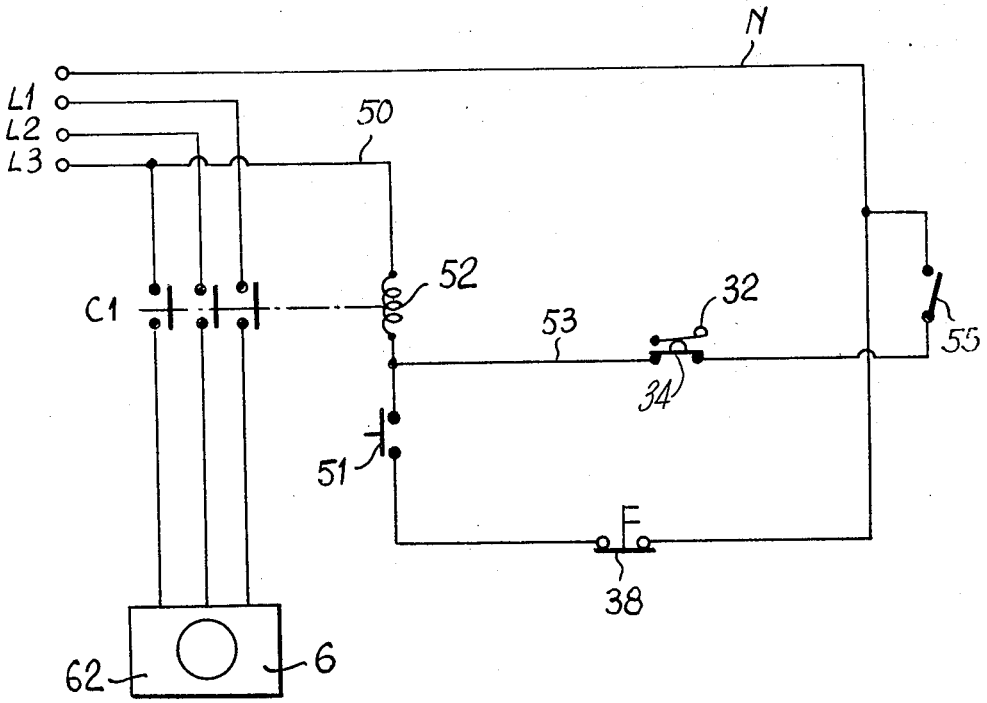
FIG. 5 is an electrical schematic drawing depicting the control circuit for the drive motor of apparatus in accordance with the invention.

The crank assembly 77 includes an outwardly extending finger 83 which interacts with the actuator 32 of electrical switch 34 interposed in the control circuit of FIG. 5.

Figure 9:
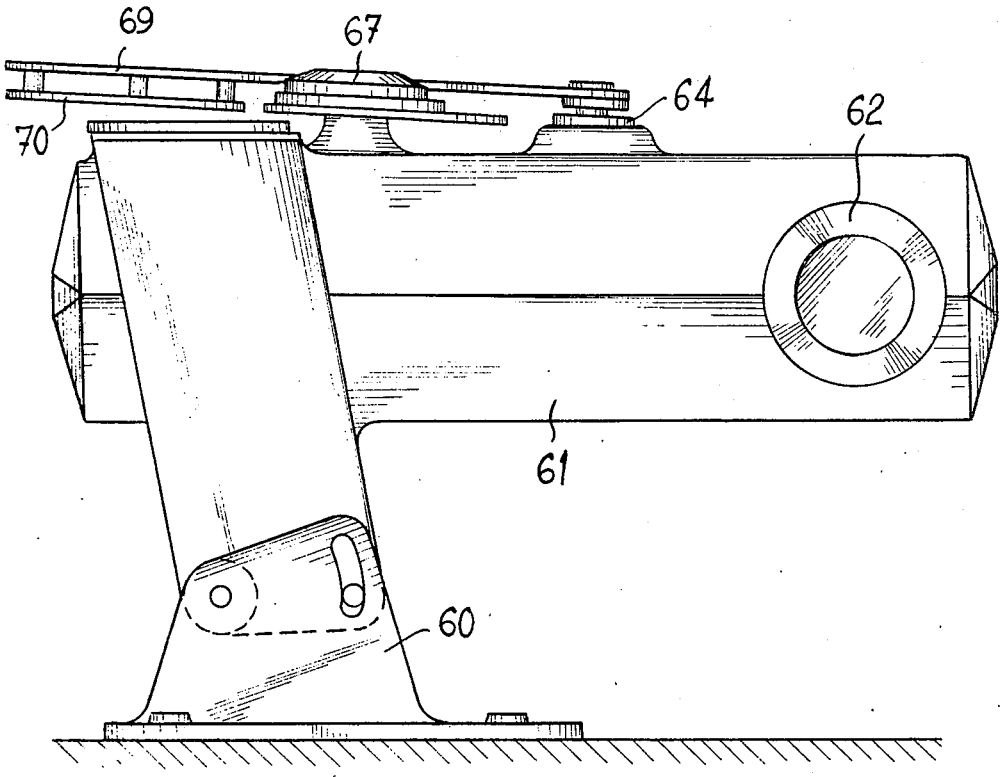
FIG. 9 is a side elevation view of a second embodiment of a target throwing device.

Referring now to FIG. 5, the control circuit is suitable for use with either the apparatus of FIGS. 1–4 or the apparatus of FIGS. 9–11. In these two apparatus, the drive motors, respectively indicated at 6 and 62, comprise three-phase electric motors which receive A.C. power from bus conductors L1, L2 and L3. A pair of normally open contacts of a control relay C1 is connected in each of the current supply lines to the drive motor. The solenoid 52 of control relay C1 is connected in a branch 50 of phase L3 of the electrical power supply. A pair of parallel circuits are connected between relay 52 and a current return or neutral leg N of the AC power supply. A first of these parallel circuits includes the normally closed contacts of switch 34; the actuating member 32 of switch 34 being operated by the fingers on the crank assemblies as discussed above. The parallel circuit including the contacts of switch 34 is completed by a main control switch 55. The second parallel circuit includes the contacts of a normally open push-button type switch 51 and the normally closed contacts of a main disconnect switch 38. The parallel circuits respectively including the contacts of switches 34 and 51 provide two distinct circuits for the energization of motors 6 or 62.

As previously described, switch 34 is normally closed and opens only when the finger 31 (FIG. 2) or 83 (FIG. 10) comes to rest against the actuator blade 32. The relative positions of actuator blade 32 and the cooperating fingers on the crank assemblies are such that when the fingers encounter the actuator blades the crank pin occupies a position slightly offset in relation to an equilibrium position in which the crank pin and pivotal shaft are situated in the same plane passing through the axis of the traction spring. Beyond this equilibrium position the traction spring will actuate the crank pin and the throwing arm will pivot under the action of the traction spring.

Figure 3:
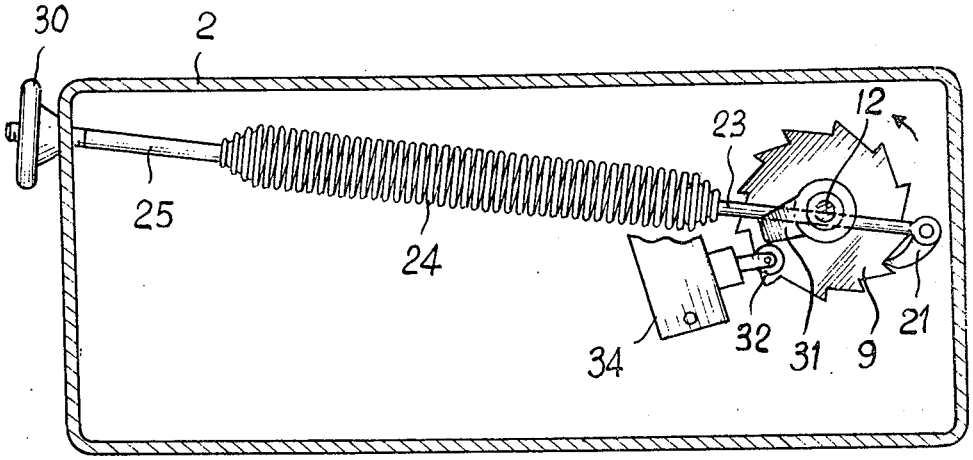
FIG. 3 is a top plan view taken along line III—III of FIG. 2.
Figure 4:
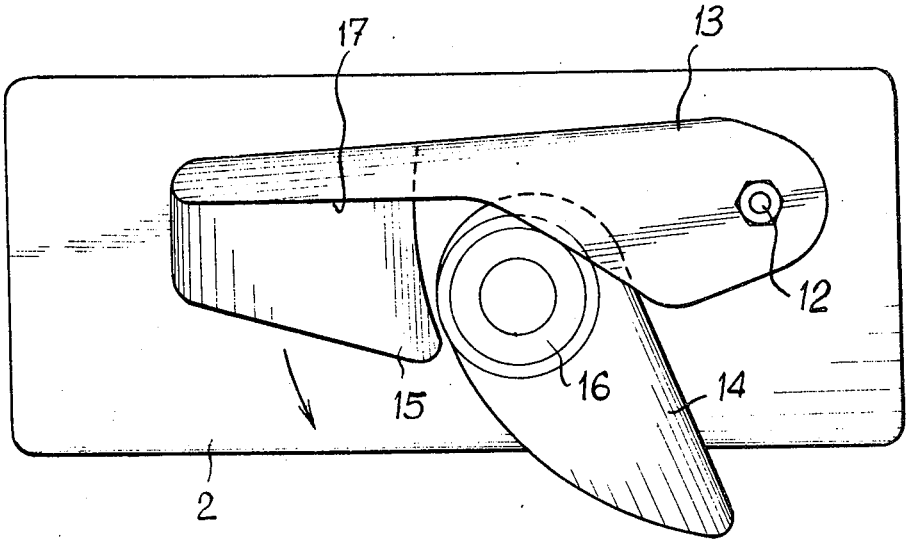
FIG. 4 is a top view depicting the throwing arm of the apparatus of FIG. 1.
Figure 6:
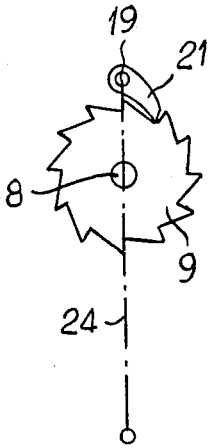
FIGS. 6, 7 and 8 are schematic illustrations of the unidirectional clamping device of the present invention and its operation.
Figure 7:
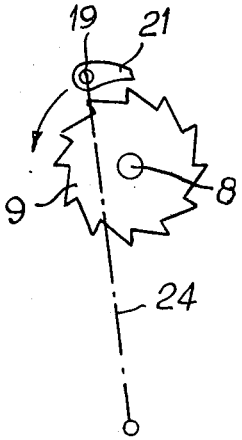

Returning now to a discussion of the operation of the apparatus of FIGS. 1–4, it will be presumed that switch 55 has been closed and crank pin 20 occupies the angular position shown in FIGS. 2 and 3. In this position the contacts of switch 34 are open since the finger 31 is in contact with the actuator blade 32 of switch 34. The parallel circuit including the contacts of switch 51 will be open since switch 51 consists of a device, typically spring loaded, which is closed only when operated to the closed position by the operator. The operation of switch 51 will cause current to flow through the solenoid 52 of control relay C1 thus causing closing of the relay contacts and energization of motor 6. Energization of motor 6 will cause rotation of shaft 8 in the direction shown by the arrow in FIG. 3. Accordingly, the ratchet 9 will drive the pawl 21 until the crank assembly 19 passes the point of equilibrium as represented in FIG. 6. After the equilibrium point is passed the crank assembly will be rotated solely under the influence of traction spring 24 and the traction spring will thus impart a high speed to arm 13 which will throw the plate 16. This condition is represented in FIG. 7.

Figure 8:
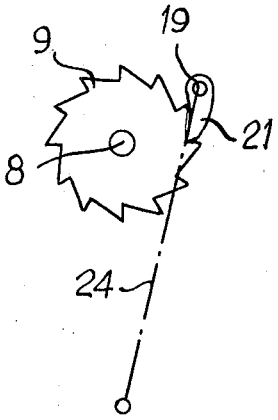

The traction spring 24 drives the crank pin 19 at a high speed and, since the throwing arm 13 is comparatively heavy, the rotating shaft 12 will "overshoot" the angular position in which the crank pin 20 is nearest to the hand wheel 30. Thus, the shaft 12 will continue to rotate past the position where spring 24 is least stretched due to the inertia of the throwing arm. Pawl 21, upon release of the throwing arm to the influence of spring 24, will thus cover a trajectory of about 270° around ratchet wheel 9. The pawl 21 will engage a tooth on ratchet wheel 9, as depicted in FIG. 8, at a point corresponding to the maximum "overshoot" and the throwing arm will become locked in this position. As may be seen from FIG. 8, which depicts the theoretical position of the pawl 21 at the end of its travel, the shaft 8 will have to pass through a relatively small angle, typically approximately 90°, to return the arm 13 to its initial partially cocked position.

After the throwing action the motor 6 continues to rotate, since the supply of current through the solenoid 52 of relay C1 is completed by the contacts of switch 34, and the ratchet wheel 9 will directly drive pawl 21 to the partially cocked position of shaft 12 and arm 13. As previously described, at the partially cocked position the finger 31 on crank assembly 19 will contact the actuator blade 32 of switch 34 to thereby open the supply circuit to solenoid 52 thus de-energizing motor 6. To restart the cycle, to throw another target plate, the operator need only again depress the control button for switch 51.

The apparatus of FIGS. 9–11 operates in a similar manner to the above described operation of the apparatus of FIGS. 1–4. It will initially be presumed that switch 55 is closed and the throwing arm 66 is in its partially cocked position. With throwing arm 66 in the partially cocked position the contacts of switch 34 are open since the finger 83 is in contact with the actuator blade 32 of switch 34. Thus, until such time as the operator depresses the button of switch 51 the solenoid 52 of control relay C1 is de-energized and the motor 62 is in the off condition. If switch 51 is actuated current is supplied to motor 62, in the manner described above, the worm gear 63 will be driven so as to cause pinion 76 to move in the direction shown by the arrow in FIG. 11. The rollers 72, thrust in this direction of rotation by the ramps 74, bear against the ring 71 and thus connect the pinion 76 to the pivotal shaft 65. As previously described, when the crank assembly passes beyond the point of equilibrim the spring 88 will cause shaft 65 to rotate. The rotation of shaft 65 under the influence of spring 82 will cause the rapid rotation of arm 66 thus throwing the plate 67.

During the throwing action arm 66 passes beyond the angular position in which spring 82 is least stretched. The pivotal shaft 65, since it cannot turn in the direction opposite to that shown by the arrow of FIG. 11, will be locked in its most forward position. The motor 62 continues to rotate during the throwing stroke and, via the unidirectional clamping device 73, drives shaft 65 to return arm 66 to its partially cocked position corresponding to the opening of the current supply circuit to solenoid 52 by co-action between finger 83 and the actuator blade 32 of switch 34. The plate throwing cycle can be repeated by the operator again depressing the button of switch 51.

While preferred embodiments have been shown and described, various modification and substitutions may be made thereto without departing from the spirit and scope of the present invention. Accordingly, it is to be understood that the present invention has been described by way of illustration and not limitation.

What is claimed is:

1. In a throwing device, said device comprising a pivotal shaft, a body which supports said pivotal shaft, a throwing arm mounted to a first end of said shaft and a crank mechanism affixed to a second end thereof, and a traction spring, said crank mechanism being mechanically coupled to the extendable end of said traction spring, the improvement comprising:

drive motor means for developing a force for positioning the throwing arm against the tension of the traction spring, said motor means including an electric motor having an output shaft;

means drivingly coupling said motor means motor output shaft to the pivotal shaft which mounts the throwing arm, said coupling means including a unidirectional clamping means, said clamping means restraining the pivotal shaft to rotation in a first direction only and thereby maintaining the pivotal shaft and the throwing arm in a position commensurate with the traction spring being under tension, said clamping means converting the kinetic energy of the traction spring to potential energy at the end of a throwing operation; and control circuit means for said drive motor means, said control circuit means automatically de-energizing said drive motor means motor after the throwing arm is spring driven to an overshoot position and locked, at which time said throwing arm is in a desired partially cocked spring tensioned position, and said control circuit means restarting said drive motor means motor whereby the pivotal shaft will be driven from the partially cocked spring tensioned position to an angular position wherein the throwing arm will be released to the influence of the traction spring acting on the crank mechanism for a throwing operation.

2. The apparatus of claim 1 wherein said coupling means clamping means comprises:

a ratchet wheel, said ratchet wheel being affixed to said drive motor means motor output shaft; and a pawl, said pawl being affixed to the crank mechanism.

3. The apparatus of claim 2 wherein said control circuit means comprises:

a solenoid operated relay, said relay including normally open contacts in the current supply path to said drive motor means motor;

a first circuit for controlling the energization of said relay solenoid, said first circuit including a normally closed first switch having an actuator juxtapositioned to the crank mechanism;

finger means attached to said crank mechanism, said finger means cooperating with the actuator of said first switch for causing the opening of said first switch to de-energize said relay solenoid when said throwing arm is in the partially cocked spring tensioned position;

a second circuit for controlling the energizaton of said relay solenoid, said second circuit including a normally opened second switch, said second switch being closed to energize said relay solenoid to thereby cause completion of the current supply circuit to said drive motor means motor to cause said motor to drive the throwing arm from the partially cocked spring tensioned position to the position where the throwing operation will occur solely under the influence of the traction spring, said drive motor means motor continuing to operate until said finger means contacts the actuator of said first switch to thereby cause de-energization of said relay solenoid and interruption of the delivery of power to said drive motor means motor when the throwing arm again reaches the partially cocked spring tensioned position.

4. The apparatus of claim 1 wherein said drive motor means motor output shaft comprises in part a worm gear and wherein said coupling means clamping means comprises:

a pinion mounted coaxially of the pivotal shaft, said pinion being engaged by said worm gear; and ratchet means coupling said pinion to the pivotal shaft.

5. The apparatus of claim 4 wherein said control circuit means comprises:

a solenoid operated relay, said relay including normally open contacts in the current supply path to said drive motor means motor;

a first circuit for controlling the energization of said relay solenoid, said first circuit including a normally closed first switch having an actuator juxtapositioned to the crank mechanism;

finger means attached to said crank mechanism, said finger means cooperating with the actuator of said first switch for causing the opening of said first switch to de-energize said relay solenoid when said throwing arm is in the partially cocked spring tensioned position;

a second circuit for controlling the energization of said relay solenoid, said second circuit including a normally opened second switch, said second switch being closed to energize said relay solenoid to thereby cause completion of the current supply circuit to said drive motor means motor to cause said motor to drive the throwing arm from the partially cocked spring tensioned position to the position where the throwing operation will occur solely under the influence of the traction spring, said drive motor means motor continuing to operate until said finger means contacts the actuator of said first switch to thereby cause de-energization of said relay solenoid and interruption of the delivery of power to said drive motor means motor when the throwing arm again reaches the partially cocked spring tensioned position.

6. The apparatus of claim 1 wherein said control circuit means comprises:

a solenoid operated relay, said relay including normaly open contacts in the current supply path to said drive motor means motor;

a first circuit for controlling the energization of said relay solenoid, said first circuit including a normally closed first switch having an actuator juxtapositioned to the crank mechanism;

finger means attached to said crank mechanism, said finger means cooperating with the actuator of said first switch for causing the opening of said first switch to de-energize said relay solenoid when said throwing arm is in the partially cocked spring tensioned position;

a second circuit for controlling the energization of said relay solenoid, said second circuit including a normally opened second switch, said second switch being closed to energize said relay solenoid to thereby cause completion of the current supply circuit to said drive motor means motor to cause said motor to drive the throwing arm from the partially cocked spring tensioned position to the position where the throwing operation will occur solely under the influence of the traction spring, said drive motor means motor continuing to operate until said finger means contacts the actuator of said first switch to thereby cause de-energization of said relay solenoid and interruption of the delivery of power to said drive motor means motor when the throwing arm again reaches the partially cocked spring tensioned position.

7. A method of throwing frangible targets comprising the steps of:

energizing a drive motor to move a pivotal throwing arm in a first direction through an arc to position the arm against the tension of a traction spring;

de-energizing the drive motor when the throwing arm reaches a desired position commensurate with partial tensioning of the spring;

latching the throwing arm in said desired position;

depositing a target on the throwing arm;

re-energizing the drive motor to move the throwing arm further in the first direction to a position where it will be caused to pivot in the first direction through a throwing stroke solely under the influence of the spring;

capturing the throwing arm in a position commensurate with the maximum overshoot of the position of maximum spring tension; and continuing the energization of the motor until the throwing arm again reaches the desired position commensurate with partial tensioning of the spring.

* * * * *

UNITED STATES PATENT OFFICE

CERTIFICATE OF CORRECTION

PATENT NO. : 3,971,357

DATED : July 27, 1976

INVENTOR(S) : Jean-Michel Laporte and Jean-Claude Laporte

It is certified that error appears in the above-identified patent and that said Letters Patent are hereby corrected as shown below:

Column 8, line 7, "equilibrim" should be --equilibrium--

Column 10, line 62, (Claim 7, line 18) "maximum" should be --minimum--

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*